US010436541B2

(12) United States Patent
Englert

(10) Patent No.: US 10,436,541 B2
(45) Date of Patent: Oct. 8, 2019

(54) SHOOTING AID

(71) Applicant: Gerald K. Englert, Dansville, NY (US)

(72) Inventor: Gerald K. Englert, Dansville, NY (US)

( * ) Notice: Subject to any disclaimer, the term of this patent is extended or adjusted under 35 U.S.C. 154(b) by 0 days.

(21) Appl. No.: 15/918,507

(22) Filed: Mar. 12, 2018

(65) Prior Publication Data

US 2018/0259290 A1 Sep. 13, 2018

Related U.S. Application Data

(60) Provisional application No. 62/469,564, filed on Mar. 10, 2017.

(51) Int. Cl.
*F41B 5/12* (2006.01)
*F41C 23/16* (2006.01)

(52) U.S. Cl.
CPC ..... *F41B 5/12* (2013.01); *F41C 23/16* (2013.01); *F41B 5/123* (2013.01)

(58) Field of Classification Search
CPC .... F41B 5/12; F41B 5/123; F41B 5/14; F41B 5/1426; F41B 5/1453; F41A 23/02; F41A 23/06; F41A 23/08; F41A 23/10
USPC ..... 124/25, 86, 89, 88
See application file for complete search history.

(56) References Cited

U.S. PATENT DOCUMENTS 1,382,409 A * 6/1921 Butler ..... F41A 23/08 42/94
1,431,058 A * 10/1922 Sutter ..... F41A 23/08 42/94
5,106,044 A * 4/1992 Regard, III ..... F41B 5/14 124/23.1
5,320,085 A * 6/1994 Hanneman ..... F41B 5/1426 124/86
5,345,706 A * 9/1994 Brown ..... F41A 23/06 42/94
5,547,162 A * 8/1996 Sobolewski ..... F41B 5/14 124/88
5,619,981 A * 4/1997 Breedlove ..... F41B 5/1426 124/86
5,964,435 A * 10/1999 Peltier ..... F41A 23/02 248/166
6,205,992 B1 * 3/2001 Meeks ..... F41B 5/14 124/86
6,957,648 B1 * 10/2005 Adcock ..... F41B 5/1426 124/86
7,036,497 B2 * 5/2006 Horn ..... F41B 5/14 124/86
7,434,773 B1 * 10/2008 Minjares ..... F41A 23/06 124/86

(Continued)

*Primary Examiner* — Alexander R Niconovich
(74) *Attorney, Agent, or Firm* — Woods Oviatt Gilman LLP; Katherine H. McGuire, Esq.

(57) ABSTRACT

A shooting aid for removable attachment to a weapon allows the weapon to rest upon another surface for more accurate shooting. The shooting aid is pivotally connected to the weapon and may be moved 180 degrees between extended and stored positions. When in the extended position, the shooting aid includes first and second spaced arms which extend substantially parallel to the longitudinal axis of the weapon and beyond the length of the weapon. In a preferred embodiment, the shooting aid is for a crossbow and the arms extend closely adjacent to and beyond the cocking stirrup when in the extended position.

11 Claims, 3 Drawing Sheets

(56) References Cited

U.S. PATENT DOCUMENTS

| | | | | |
|---|---|---|---|---|
| 7,677,233 | B2 * | 3/2010 | Bednar | F41A 23/06 124/25 |
| 8,328,147 | B2 * | 12/2012 | Gardner | F41A 23/06 124/86 |
| 8,720,424 | B2 * | 5/2014 | Kempf | F41B 5/10 124/25 |
| 9,022,013 | B2 * | 5/2015 | Trpkovski | F41B 5/10 124/25 |
| 9,279,635 | B2 * | 3/2016 | Torbett | F41B 5/1453 |
| 9,310,153 | B2 * | 4/2016 | Nettleton | F41A 23/10 |
| 9,423,203 | B2 * | 8/2016 | Simonds | F41B 5/123 |
| 9,453,699 | B1 * | 9/2016 | Barnett | F41B 5/123 |
| 9,470,467 | B2 * | 10/2016 | Englert | F41A 23/16 |
| 9,568,266 | B1 * | 2/2017 | LoRocco | F41A 23/06 |
| 9,784,521 | B2 * | 10/2017 | Bartak | F41A 23/10 |
| 9,803,950 | B1 * | 10/2017 | Khoshnood | F41B 5/1453 |

* cited by examiner

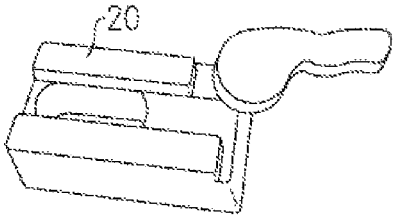
FIG.4
FIG.5
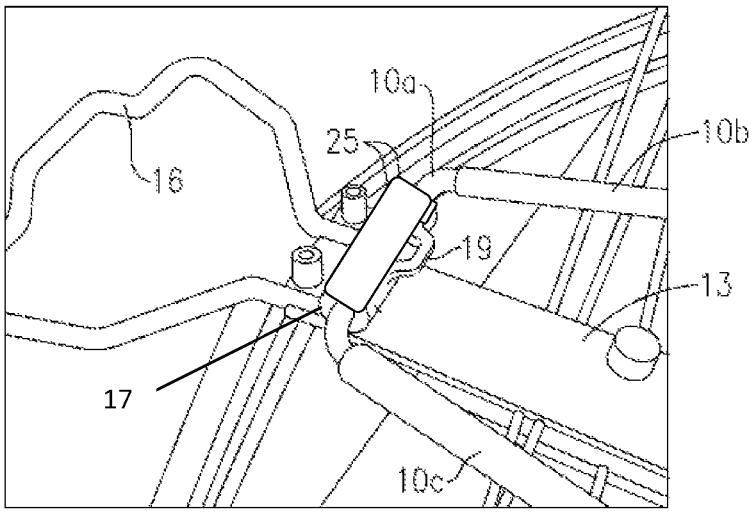
FIG.6
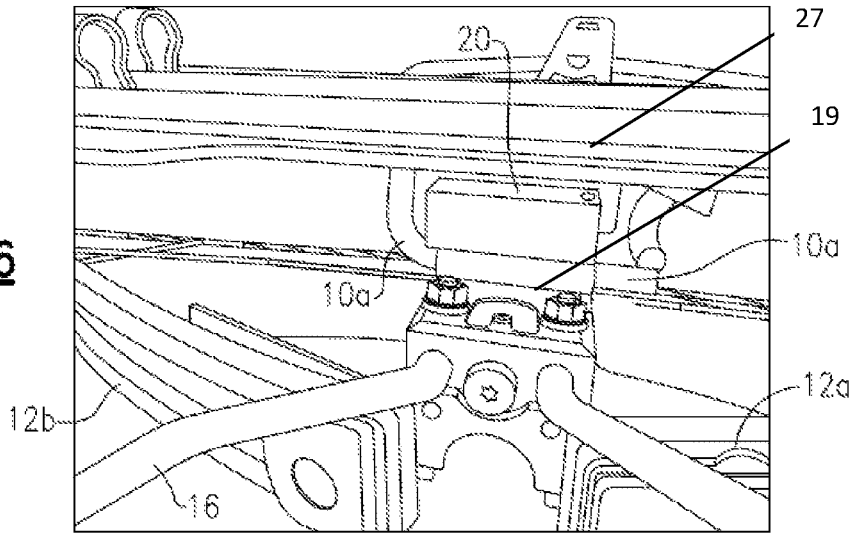

SHOOTING AID

BACKGROUND OF THE INVENTION

The present invention relates to devices for aiding a shooter aim and fire a weapon at a target. More particularly, the invention relates to a shooting aid configured for removable attachment to a weapon such as a cross bow that may be used to support and more accurately aim the weapon when firing.

SUMMARY OF THE INVENTION

The present invention provides a shooting aid comprising a rest that is configured for laying and resting upon a surface such as a generally horizontally extending member (e.g., as is found on a fence or frame). The shooting aid is adapted for removable attachment to the weapon. For example, the shooting aid may include a rod having an end that may be secured to the existing bracket on a crossbow. The shooting aid includes a frame that extends from the secured end of the rod. The frame may have a variety of shapes but preferably has at least two spaced bars that are of a length allowing the frame to easily rest upon a horizontally extending member. The shooter may thus rest the weapon in the shooting position by placing the two frame bars on the horizontally extending member. The shooter may aim the weapon and shoot the target with much more control than when shooting without a rest.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein:

FIG. 4 is a perspective view of a prior art quiver holder;

FIG. 5 is an enlarged, fragmented perspective view of embodiment of FIGS. 1-3 with the quiver holder removed to illustrate the shooting aid attachment mechanism with the shooting aid in the stored position;

FIG. 6 is a fragmented, perspective view looking toward a user holding the cross bow and showing the quiver block and quiver attached to the cross bow with the shooting aid in the stored position;

DETAILED DESCRIPTION

Figure 1:
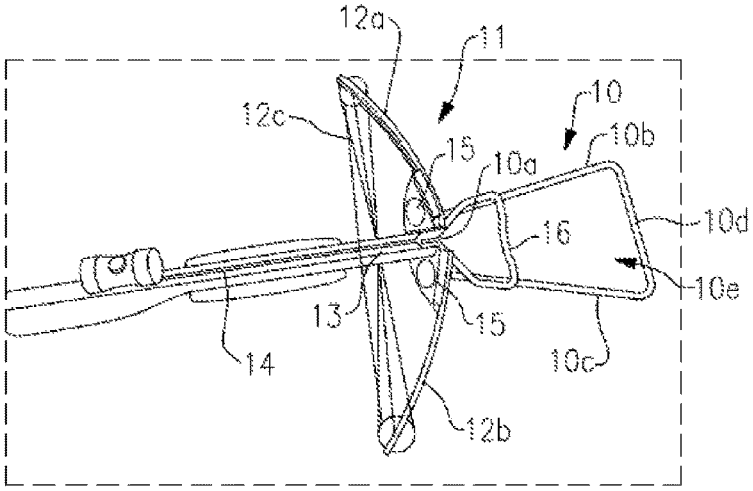
FIG. 1 is a perspective view of one possible embodiment of the shooting aid attached to a cross bow with the shooting aid shown in the extended and secured position.

Referring now to Figures, an embodiment of the invention is seen to include a shooting aid 10 comprising a rest for a weapon such as a cross bow 11 having arms 12*a* and 12*b* secured to a handle 14 via a neck 13 and bracket 15. A cocking stirrup 16 is provided allowing the user to secure the bow with a foot on the ground while drawing back the bow strings 12*c* and arms 12*a* and 12*b* to cock the bow 11 in a known manner.

Figure 2:
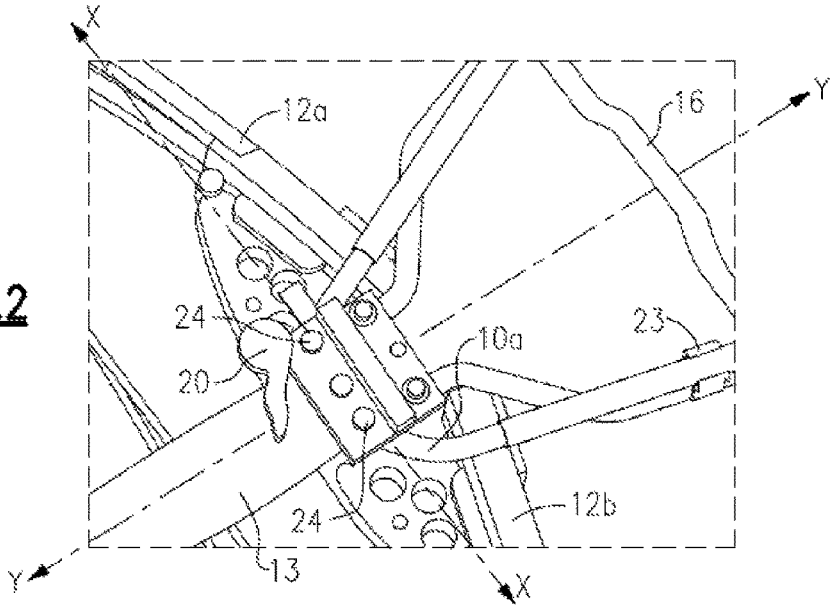
FIG. 2 is an enlarged view of a portion of FIG. 1 with the shooting aid shown in the extended and secured position.
Figure 7:
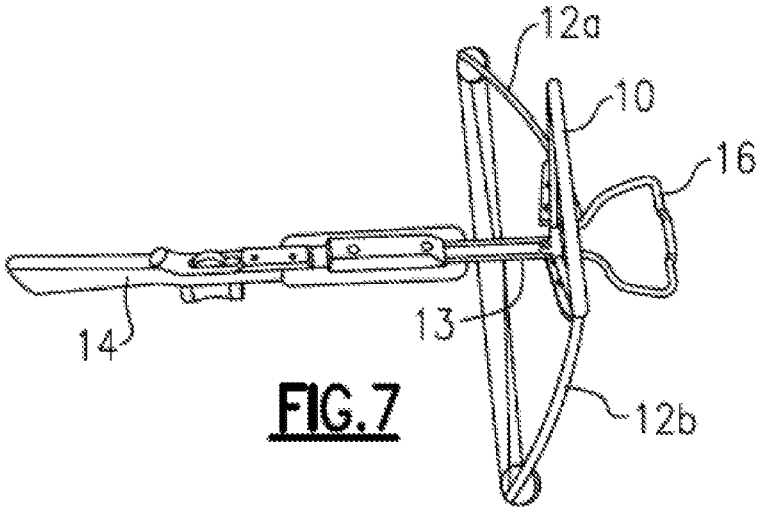
FIG. 7 is a perspective view of a user holding the cross bow and the shooting aid in a position between the fully extended and fully stored positions.

Shooting aid 10 includes a secured end 10*a* which is pivotally attached to cross bow 11 at or near the location of bracket 15. As seen best in FIG. 2, secured end 10*a* is in the form of a rod and telescopes within and is pivotally secured to bow 11 in any desired manner and, in the preferred embodiment, by a cylindrical fitting 17 (FIG. 5) which allows secured end 10*a* to pivot about an axis X-X which extends perpendicular to the longitudinal axis Y-Y of handle 14 and neck 13 (FIG. 2). This allows the shooting aid 10 to be selectively pivoted between an extended (FIGS. 1-3) and a stored position (FIGS. 5 and 6). FIG. 7 illustrates a position where the shooting aid 10 is in a position between the fully extended and fully stored positions.

Cylindrical fitting 17 may be secured to cross bow 11 in any desired manner. In the embodiment illustrated in the figures, cylindrical fitting 17 is secured to the bracket 19 to which the quiver holder 20 is secured (see FIGS. 4-6). This may be accomplished by first removing the quiver holder 20 by removing threaded bolts 24 (FIG. 2) from respective openings 25 (see FIG. 5 in which quiver holder 20 has been removed). Once fitting 17 is positioned at bracket 19, the quiver holder 20 is replaced and secured via bolts 24 which thereby also secures fitting 17 in place. The quiver 27 is seen in FIG. 6. As is known in the art, the user carries the quiver with arrows on the bow and then removes it prior to cocking an arrow in the bow.

Shooting aid 10 includes at least one but preferably first and second arms 10*b* and 10*c* which extend from secured end 10*a*. A third arm 10*d* may interconnect first and second arms 10*b* and 10*c* opposite secured end 10*a*. First and second arms 10*b* and 10*c* may extend in either a parallel or an angled fashion. For example, in the embodiment shown, the arms extend in a diverging fashion such that the distance between them at optional third arm 10*d* is longer than the distance between them at secured end 10*a*. When extended, shooting aid 10 lies closely adjacent cocking stirrup 16 and extends longer than stirrup 16 (e.g., about 8-10 inches past stirrup 16).

Figure 8:
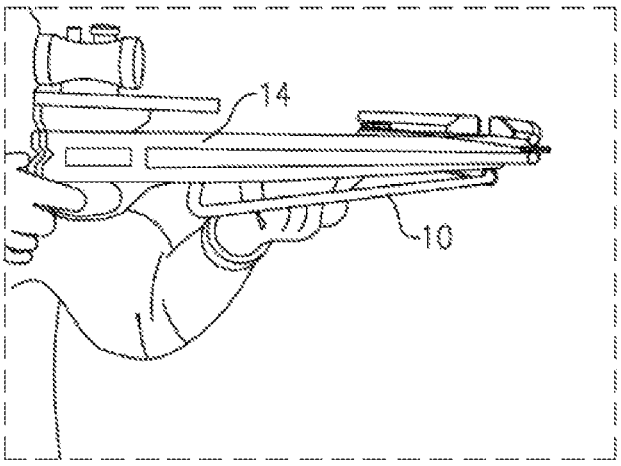
FIG. 8 is a perspective view of a user holding and aiming the cross bow in a ready to fire position with the shooting aid shown in the fully stored position.

When not being used to steady the cross bow 11 on a horizontal surface, shooting aid 10 may be pivoted to its stored position shown in FIGS. 5 and 8. Although it is understood the shooting aid 10 may assume a variety of shapes and sizes depending on the preferences of the user and type of cross bow it is to be used with, the dimensions and geometry of shooting aid 10 are preferably chosen so as to not interfere with the user's normal handling of the cross bow 11. In the embodiment shown in the figures, shooting aid 10 is pivoted to the stored position and secured in place by positioning it against handle 14 and a hook and loop fastener or other securing means may be used to releasably secure one to the other, if desired.

Figure 3:
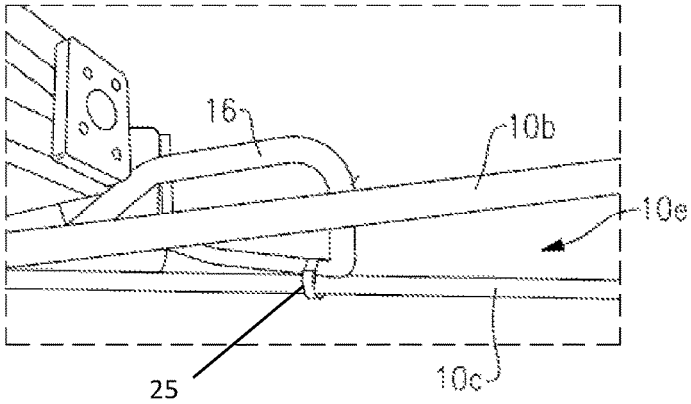
FIG. 3 is a fragmented, perspective view of the shooting aid showing an alternate means of securing the shooting aid to the cocking stirrup when in the extended position.

In the fully extended position, shooting aid 10 may be secured to stirrup 16 with any desired securing means such as a U-clip 23 (FIG. 2) or cooperating hook and loop fastener tabs 25 adhered to each, respectively (FIG. 3).

When readying to shoot, the shooter rests bars 10*a* and 10*b* on top of any suitable, generally horizontal surface such as a rail, tree limb, fence or frame, for example (not shown). The arms 10*b* and 10*c* are elongated so that the shooter can easily slide the shooting aid 10 against the horizontal to aim the weapon at the target. While the invention has been described with respect to use with a compound bow, it is understood that the invention may be used on any other desired weapon and may be adapted for removable attachment at other attachment points on the weapon that are already existing or newly formed thereon (e.g., a newly tapped hole in the frame of the weapon). The attachment may be via any desired connection means including threaded and non-threaded holes, for example.

The entire shooting aid 10 may be of unitary construction or be separate components that are connected together. The shooting aid 10 may also be of any desired material including metals, plastics, composites, etc., for example.

While this method and apparatus has been shown and described with reference to certain preferred embodiments thereof, it will be understood by those skilled in the art that various changes in form and details may be made therein without departing from the spirit and scope of the invention.

What is claimed is:

1. A shooting aid adapted for removable attachment to a cross bow having a handle and neck extending along a longitudinal axis and a cocking stirrup, said shooting aid comprising:

a) a secured end;

b) first and second arms extending from said secured end;

c) a fitting attachable to the cross bow, said secured end pivotally connected to said fitting such that said shooting aid is selectively pivotally movable substantially 180 degrees between a stored position and an extended position relative to the cross bow whereby when in said stored position, said first and second arms extend substantially parallel to said longitudinal axis and adjacent the cross bow, and when in said extended position, said first and second arms extend substantially parallel to said longitudinal axis and beyond the length of the cross bow allowing the first and second arms to rest upon a horizontal surface to steady the cross bow prior to firing the cross bow, whereby said shooting aid is independently movable with respect to said cocking stirrup and said shooting aid lies closely adjacent and substantially parallel to said cocking stirrup when in said extended position.

2. The shooting aid of claim 1 wherein said first and second arms extend in a diverging manner in a direction away from said secured end.

3. The shooting aid of claim 2 and further comprising a third arm connected to and extending between said first and second arms.

4. The shooting aid of claim 3 wherein the cross bow includes a quiver holder and said fitting is mounted adjacent said quiver holder.

5. The shooting aid of claim 4 and further comprising a fastener removably securing the shooting aid in the extended position with said fastener securing one of said first and second arms to the stirrup.

6. The shooting aid of claim 5 wherein said fastener is a U-shaped clip.

7. The shooting aid of claim 5 wherein said fastener is a loop and hook fastener.

8. The shooting aid of claim 1 wherein said cocking stirrup is not pivotable with respect to said cross bow.

9. The shooting aid of claim 8 wherein said shooting aid extends about 8-10 inches beyond the cocking stirrup when in said extended position.

10. The shooting aid of claim 1 wherein said shooting aid lies closely adjacent and substantially parallel to said cocking stirrup when in said extended position, and further comprising a fastener removably securing the shooting aid in the extended position with said fastener securing one of said first and second arms to the cocking stirrup.

11. The shooting aid of claim 10 wherein said shooting aid extends about 8-10 inches beyond the cocking stirrup when in said extended position.

* * * * *